United States Patent [19]

Iizuka

[11] 4,129,352

[45] Dec. 12, 1978

[54] PIN PLUG

[75] Inventor: Akichika Iizuka, Kanra, Japan

[73] Assignee: Iizuka Electric Industry Company Limited, Tomioka, Japan

[21] Appl. No.: 839,073

[22] Filed: Oct. 3, 1977

[51] Int. Cl.[2] ..... H01R 17/06

[52] U.S. Cl. ..... 339/177 R; 339/210 R

[58] Field of Search ..... 339/177 R, 177 E, 182 R, 339/107, 208, 210 R

[56] References Cited

U.S. PATENT DOCUMENTS

| | | | |
|---|---|---|---|
| 1,659,447 | 2/1928 | Smith | 339/210 R |

FOREIGN PATENT DOCUMENTS

| | | | |
|---|---|---|---|
| 1903398 | 9/1969 | Fed. Rep. of Germany | 339/177 R |
| 2342427 | 3/1975 | Fed. Rep. of Germany | 339/177 R |
| 695439 | 12/1953 | United Kingdom | 339/177 E |
| 887853 | 1/1962 | United Kingdom | 339/177 R |

*Primary Examiner*—Neil Abrams

*Attorney, Agent, or Firm*—Lawrence I. Field

[57] ABSTRACT

A pin plug comprises an inner contact member in the form of a pin made of metal, an outer contact member in the form of a cylindrical metal body and an insulating member for fixing the inner and outer contact members in position in an electrically insulating manner. Said insulating member comprises an inner insulating member consisting of two semi-cylindrical halves which form in a joined condition a hollow cylindrical space in which said inner contact pin is fit. The insulating member further comprises an outer insulating member or cover made of relatively resilient material. The outer contact member consists of two semi-cylindrical halves which are fixed around the outer surface of the inner insulating member. The assembly of the inner contact pin, the inner insulating member surrounding the pin and the outer contact member surrounding the inner insulating member is resiliently inserted into the space of the outer insulating cover. An electric wire having two conductors is passed through the outer insulating cover and one of the conductors is connected to the inner contact pin and the other conductor is connected to the outer contact member. The pin plug can be easily taken apart by removing the outer insulating cover from the assembly of the inner and outer contact members and the inner insulating member.

10 Claims, 12 Drawing Figures

FIG. 7
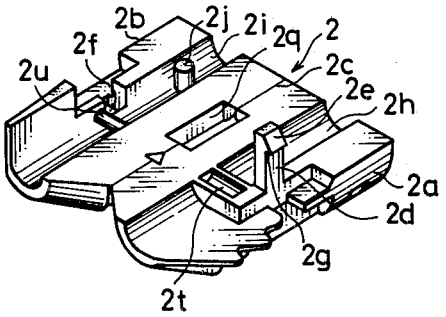
FIG. 8a
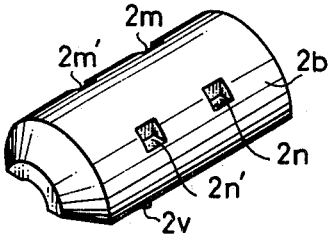
FIG. 8b
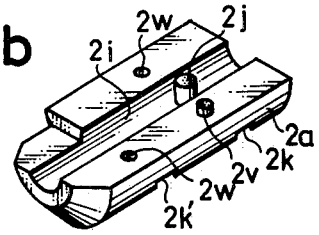
FIG. 9
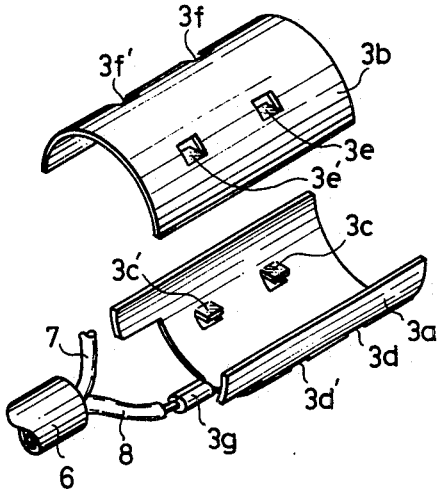
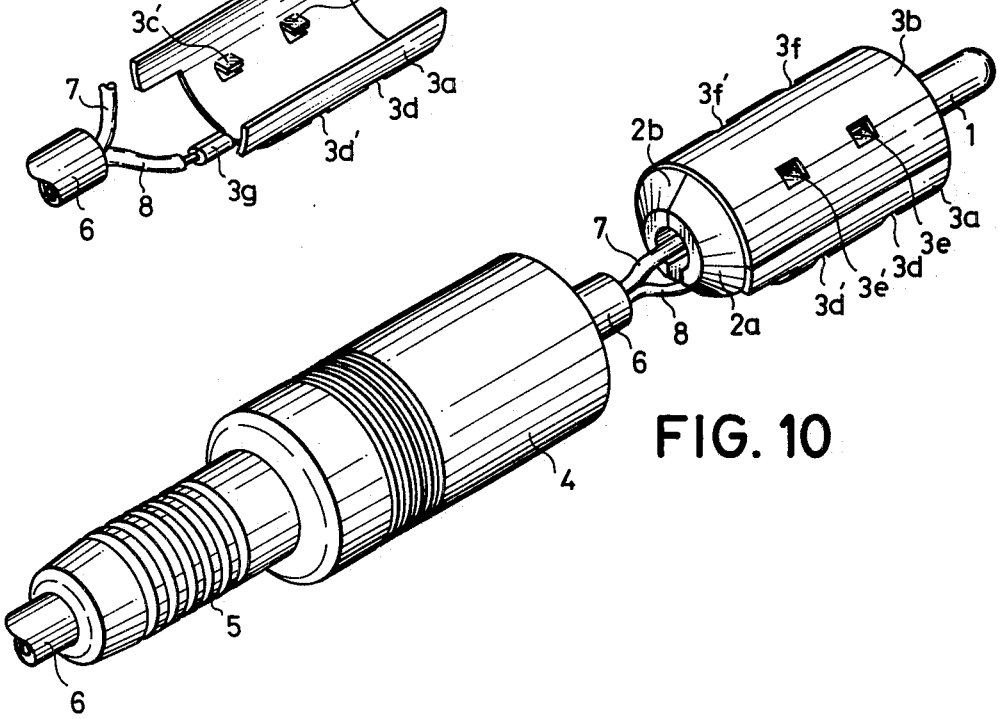
FIG. 10

PIN PLUG

BACKGROUND OF THE INVENTION

The present invention relates to a pin plug comprising an inner contact member in the form of a pin made of electrically conductive metal, an outer contact member in the form of a hollow cylindrical body made of electrically conductive material and an electrically insulating member for fixing said inner and outer contact members in position in an electrically isolated manner, whereby one of two conductors of an electric wire is connected to said inner contact member and the other conductor is connected to the outer contact member.

Such pin plugs are used in various electronic and electric apparatuses. For example, an audio apparatus of a system componets type various conponents such as a radio tuner, a pre-amplifier, a main amplifier, a record disc player, a magnetic tape deck, a loudspeaker system are interconnected by means of electric wires having the pin plugs connected at their ends. In case of a stereophonic audio apparatus two electric wires each conducting right and left channel signals, respectively are usually bundled as a single wire code. Such a wire code has four pin plugs. Even if one of the four pin plugs is broken, the whole wire code could not be used, because the known pin plug is difficult to repair. Therefore a yield of such a pin plug wire is very small.

In one of the known pin plugs use is made of an electrically insulating plate and the inner and outer contact members are fixed in position by means of the insulating plate. Then the assembly is covered with an electrically insulating cover by molding. Such a pin plug cannot be manufactured in a simple manner and has a poor electrical property, particularly a poor insulating characteristic. In another known pin plug the inner and outer contact members are inserted at suitable positions in molds and are fixed in position by molded body of electrically insulating material. This pin plug has a relatively good electrical property, but its mechanical strength is not so large. Particularly such a pin plug has a drawback that its yield is relatively low. At any rate in the known pin plug since the pin plug could not be taken apart or disassembled after the outer mold of insulating material has been applied, when its electrical or mechanical property becomes deteriorated, the whole wire having the pin plugs attached at its ends cannot be used any longer.

The present invention has for its object to provide a pin plug which can be easily manufactured and taken apart in a simple manner, so that even if the pin plug has a poor insulating characteristic, a disconnection of conductors, etc., it can be easily repaired.

Another object of the present invention is to provide a pin plug which has excellent electrical and mechanical properties.

It is still another object of the invention to provide a pin plug which can be manufactured with a very high yield.

SUMMARY OF THE INVENTION

A pin plug according to the invention comprises an inner contact member in the form of pin made of conductive material; an inner insulating member consisting of two semi-cylindrical halves made of insulating material, said two halves forming with their inner surfaces a hollow cylindrical space extending in an axial direction and receiving said pin; means formed in said pin and the inner surface of said inner insulating member for fixing said pin in position in said cylindrical space in a removable manner; means formed in said two halves of the inner insulating member for assembling them together in a separable manner; an outer contact member consisting of two semi-cylindrical halves and surrounding an outer surface of said inner insulating member; means formed in said inner insulating member and outer contact member for fixing the outer contact member in position on the outer surface of the inner insulating member in a separable manner; and an outer insulating member consisting of a hollow cylindrcal body made of relatively resilient insulating material and enclosing in a separable manner an assembly of the pin, the inner insulating member surrounding the pin and the outer contact member surrounding the inner insulating member so as to hold the assembly in position; whereby said pin is connected to one of two conductors of an electric wire, the other conductor of which is connected to said outer contact member and said electric wire is slidably passed through said outer insulating member.

In a preferred embodiment of the pin plug according to the invention said means for fixing the pin and the inner insulating member in a separable manner comprise a hole formed in said pin and a projection formed on the inner surface of the inner insulating member and inserted in said hole.

According to a further preferred embodiment of the pin plug of the invention said means for fixing the outer contact member and the inner insulating member in position in a separable manner comprise recesses formed in the outer surface of the inner insulating member and inwardly projecting lugs formed in the outer contact member and inserted in said recesses.

In a preferred embodiment of the pin plug according to the invention said two halves of the inner insulating member are coupled to each other along one edge parallel to the axial direction in such a manner that these two inner insulating member halves can be freely bent along said edge.

Other aspects of the pin plug according to the invention will be made clear by the following description with refereuce to the drawings.

BRIEF DESCRIPTION OF THE DRAWINGS

FIG. 7 is a perspective view illustrating an inner surface configuration of an inner insulating member of another embodiment of the pin plug according to the invention;

FIGS. 8*a* and 8*b* are perspective view showing two inner insulating member halves, respectively of another embodiment of the pin plug according to the invention;

FIG. 9 is a perspective view depicting two outer contact member halves which cooperate with the inner insulating member shown in FIG. 8; and FIG. 10 is a perspective view showing the assembly of the pin, inner insulating member and the outer contact member and an outer insulating member.

DESCRIPTION OF THE PREFERRED EMBODIMENTS

Figure 1:
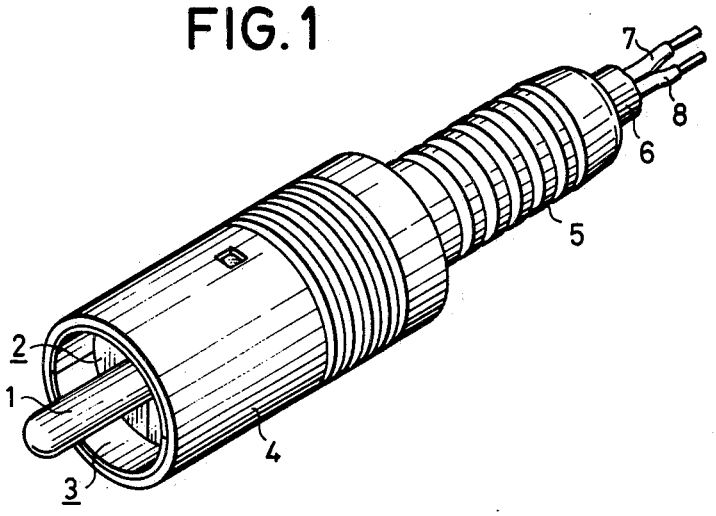
FIG. 1 is a perspective view illustrating one embodiment of a pin plug according to the invention.

FIG. 1 is a perspective view illustrating a preferred embodiment of a pin plug according to the invention. The pin plug according to the invention comprises an inner contact member 1 in the form of a pin made of an electrically conductive metal plate and an inner insulating member 2 in the form of a hollow cylindrical body made of electrically insulating material such as resin having relatively large hardness. As explained later the inner insulating member 2 consists of two semi-cylindrical halves. The pin plug further comprises an outer contact member 3 in the form of a hollow cylindrical sheath made of electrically conductive metal plate and an outer insulating member or cover 4 made of relatively resilient insulating material. The outer contact member 3 also consists of two semi-cylindrical halves. The outer insulating member 4 is substantially cup-shaped. In an elongated bottom portion 5 of the cup-shaped body there is formed an elongated hole through which an electric wire 6 having two conductors 7 and 8 is passed. Diameters of the hole and the wire are so selected that the outer insulating cover 4 can slide along the wire in a relatively smooth manner. The function of this will be made clear in the later explanation.

Figure 2A:
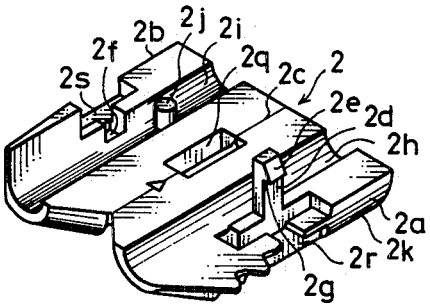
FIGS. 2 (*a*) and 2 (*b*) are perspective views showing inner and outer surface configurations, respectively of an inner insulating member.
Figure 2B:
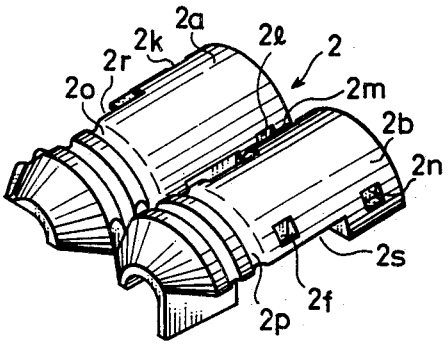

FIGS. 2*a* and 2*b* show a construction of the inner insulating member 2. As described above the inner insulating member 2 consists of the two semi-cylindrical halves 2*a* and 2*b* which are integrally formed by molding. These two halves are connected to each other along one edge 2*c* which is made thin and operates as a hinge. Thus the two halves 2*a* and 2*b* can be freely bent along said edge 2*c*. On the inner surface of one of the halves 2*a* is integrally formed a projection 2*d* having a tapered top 2*e* near the other edge opposite to the edge 2*c* and in the inner surface of the other half 2*b* is formed a rectangular hole 2*f* near the other edge opposite to the edge 2*c*. When these two halves 2*a* and 2*b* are joined together by bending them along the edge 2*c*, the projection 2*d* is inserted into the hole 2*f* and a stepped portion 2*g* engages with the ridge of the hole 2*f* so that the two halves 2*a* and 2*b* are firmly coupled to each other. The tapered top 2*e* makes easy the insertion of the projection 2*d* into the hole 2*f*. Since the projection 2*d* is resilient when the tapered top 2*e* is pushed by means of a suitable tool such as a needle the two halves may be easily disengaged. In the inner surfaces of these halves 2*a* and 2*b* there are formed semi-circular recesses 2*h* and 2*i* respectively extending in an axial direction. Thus in the coupled condition there is formed a hollow cylindrical space in which the inner contact pin 1 can be installed. On the inner surface of the semi-circular recess 2*i* is integrally formed a small projection 2*j* in the form of a pin. This projection 2*j* serves to fix the inner contact pin 1 in position in an assembled condition. Further on the outer surface of the respective halves 2*a* and 2*b* are formed two depressions 2*k*, 2*l*, and 2*m*, 2*n*, respectively. The function of these depressions will be explained later.

Figure 3:
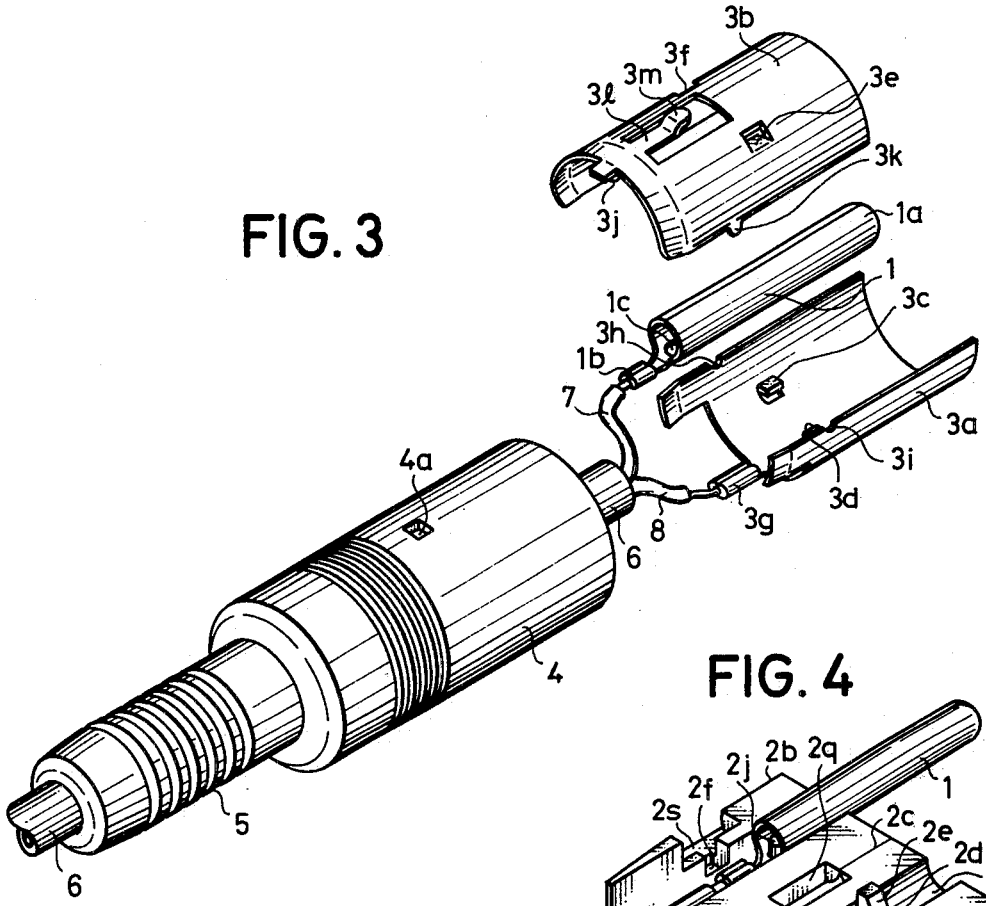
FIG. 3 is a perspective view illustrating inner and outer contact members and an outer insulating member.

FIG. 3 is a perspective view illustrating the configuration of the inner and outer contact members 1 and 3. The inner contact pin 1 has a round top 1*a* and a clamping terminal 1*b* by means of which the conductor 7 is connected to the pin 1. Near the clamping terminal 1*b* is formed a hole 1*c* into which is inserted the projection 2*j* formed in the inner insulating member half 2*b* when the pin 1 is installed in the semi-circular recess 2*i* of the half 2*b* so that the pin 1 is fixed in position in the hollow cylindrical space formed by the coupled two halves 2*a* and 2*b*.

The outer contact member 3 consists of two semi-cylindrical halves 3*a* and 3*b*. These two halves 3*a* and 3*b* are placed on the outer surface of the outer insulating member 2. In these outer contact member halves 3*a* and 3*b* are integrally formed inwardly bent lugs 3*c*, 3*d* and 3*e*, 3*f*, respectively. When the outer contact member halves 3*a* and 3*b* are placed around the inner insulating member 2, the lugs 3*c* and 3*f* engaged with the depressions 2*k* and 2*l*, respectively and the lugs 3*d* and 3*e* engage with the depressions 2*n* and 2*m*, respectively. Thus the outer contact member halves 3*a* and 3*b* are fixed in place in a stable manner. The outer contact member half 3*a* has integrally formed a clamping terminal 3*g* by means of which the conductor 8 is connected to the outer contact member half 3*a*. In the assembled condition the two outer contact member halves 3*a* and 3*b* are electrically connected to each other, because side edges of these halves 3*a* and 3*b* have made contact together. In order to avoid the relative displacement of these halves 3*a* and 3*b* in the axial direction on the side edges of these halves are formed semi-circular cut away portions 3*h*, 3*i* and corresponding semi-circular projections 3*j*, 3*k*, respectively. Moreover the rear ends of these two halves 3*a* and 3*b* are slightly bent inwardly and are inserted in circular recesses 2*o* and 2*p*. In this manner the outer contact member halves 3*a* and 3*b* can be firmly fixed in position around the outer surface of the inner insulating member 2.

In the outer contact member half 3*b* there is further formed a resilient strip 31 having a raised top portion 3*m*. As will be explained later when the assembly of the pin 1, the inner insulating member 2 and the outer contact member 3 is inserted into a hollow space of the outer insulating cover 4, the raised top portion 3*m* of the outer contact member half 3*b* is clicked into a rectangular recess 4*a* formed in the outer insulating cover 4.

Figure 4:
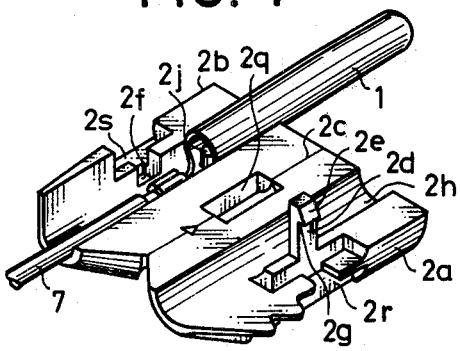
FIG. 4 is a perspective view showing a manner of fixing a pin contact member in the inner insulating member.

FIG. 4 is a perspective view illustrating how to place the inner contact pin 1 in position in the semi-cylindrical recess 2*i* of the inner insulating member half 2*b*. The small projection 2*j* formed on the inner surface of the recess 2*i* is inserted in the hole 1*c* formed in the pin 1, so that the movement of the pin 1 relative to the inner insulating member 2 in the axial direction as well as a rotational movement of the pin 1 can be effectively prevented.

Figure 5:
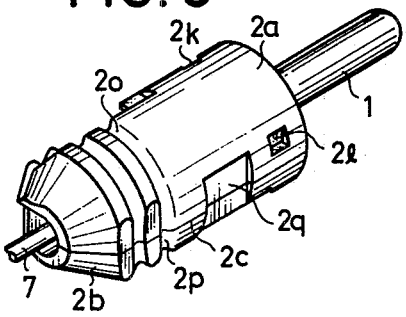
FIG. 5 is also a perspective view depicting an assembly of the pin and inner insulating member.

After the pin 1 has been placed in the recess 2*i* of the inner insulating member half 2*b* as shown in FIG. 4 the two halves 2*a* and 2*b* are coupled together by bending the half 2*a* along the edge 2*c* and are locked together by means of the projection 2*d* and the hole 2*f* so as to obtain an assembly of the pin 1 and inner insulating member 2 as shown in FIG. 5. In FIG. 5 there is illustrated a cut away portion 2*q* at the one edge 2*c* of the inner insulating member 2. This cut away portion 2*q* serves as a merginal space for the raised portion 3*m* of the resilient strip 31 in case of depressing the latter. Therefore when the outer contact member 3 is placed around the inner insulating member 2, the outer contact member half 3*b* is placed in such a manner that the resilient strip 31 faces against the cut away portion 2q. As shown in FIGS. 2 and 4 the inner insulating member halves 2a and 2b have formed at their other edges opposite to the edge 2c inwardly cut away portion 2r and 2s, respectively. When these two halves 2a and 2b are coupled together these cut away portions form an integral space for accomodating the clamping terminal 3g and the conductor 8 connected thereto.

Figure 6:
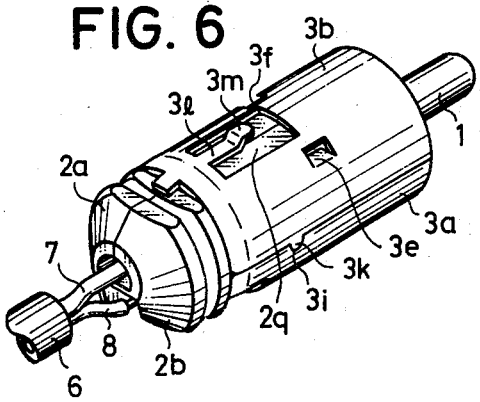
FIG. 6 is a perspective view showing a manner of placing an outer contact member to the assembly of FIG. 5.

FIG. 6 is a perspective view illustrating the assembly of the pin 1, the inner insulating member 2 enclosing the pin 1 and the outer contact member 3 surrounding the inner contact member 3. Then the assembly is inserted in the space of the outer insulating member 4 in such a manner that the raised top portion 3m of the resilient strip 31 of the outer contact member half 3b fits into the recess 4a formed in the outer insulating cover 4. In this manner the complete pin plug shown in FIG. 1 can be obtained. As can be seen in FIG. 6 the direction of the contact surfaces of the two inner insulating member halves 2a and 2b is perpendicular to the direction of the contact surfaces of the two outer contact member halves 3a and 3b viewed in the axial direction and thus the mechanical strength of the pin plug is very large.

As explained above the pin plug according to the invention can be easily manufactured and has excellent electrical and mechanical property. Particularly its insulating preperty is very good. Moreover the pin plug according to the invention can be easily taken apart and thus even if the pin plug might be damaged or destroyed, it can be repaired in a very simple manner. Therefore a yield of the pin plug of the invention is very high and thus the cost thereof can be decreased.

FIG. 7 is a perspective view showing another embodiment of the inner insulating member 2 of the pin plug according to the invention. In this embodiment the parts which are the same as those of the previous embodiment are denoted by the same reference numerals. In this embodiment on the semi-circular inner surface 2h of the inner insulating member half 2a is formed a recess 2t extending in a lateral direction at right angles to the axial direction and on the inner surface of the semi-circular recess 2i of the other inner insulating member half 2b is integrally formed a semi-cylindrical projection 2u. When the two halves 2a and 2b are joined together after the pin 1 has been inserted in the recess 2i of the half 2a, the projection 2u is inserted into the recess 2t. Therefore the conductor 7 connected to the pin 1 is clamped between these projection 2u and the recess 2t so that the conductor 7 cannot be pulled out in the axial direction.

FIGS. 8a and 8b show another embodiment of the inner insulating member of the pin plug according to the invention. In this embodiment two inner insulating member halves 2a and 2b are formed as separate bodies and these two halves are joined together in a detachable manner by means of pins 2v and holes 2w formed in the contact surfaces of these halves 2a and 2 b. That is to say these two halves can be fixed together by inserting the pins 2v into the corresponding holes 2w. Moreover in this embodiment in the outer surface of the respective half there are formed four rectangular depressions 2k, 2k', 2l, 2l' and 2m, 2m', 2n, 2n', respectively (in FIG. 8b only the two depressions 2k and 2k' can be seen).

FIG. 9 is a perspective view showing two outer contact member halves 3a and 3b which cooperate with the inner insulating member shown in FIGS. 8a and 8b. In these outer contact member halves 3a and 3b are formed inwardly bent projections 3c, 3c', 3d, 3d' and 3e, 3e', 3f, 3f', respectively. When the outer contact member halves 3a and 3b are placed around the inner insulating member, the projections 3c, 3c' and 3d, 3d' of the half 3a are inserted in the recesses 2m, 2m' and 2l, 2l' of the inner insulating member halves 2a and 2b, respectively and the projection 3e, 3e' and 3f, 3f' of the other half 3b are fit in the recesses 2k, 2k' and 2n, 2n' of the inner insulating member halves 2a and 2b, respectively.

FIG. 10 is a perspective view showing the assembly of the pin 1, the inner insulating member halves 2a and 2b and the outer contact member halves 3a and 3b. As shown in FIG. 10 the contact surface of the halves 2a and 2b is perpendicular to the contact surface of the halves 3a and 3b in the coupled condition. Thus the relative movement of these halves in the axial and circumferential directions can be effectively avoided. As explained above in the previous embodiment the assembly is resiliently inserted in the hollow space of the outer insulating member 4.

The present invention is not limited to the embodiments explained above, but many modifications are possible within the scope of the invention. For example the means for fixing the pin 1 in the inner insulating member 2 may be formed in various ways. For instance an outwardly projected lug may be formed in the pin 1 and a corresponding recess may be formed in the inner surface 2i of one of the two inner insulating member halves 2b. Further the number of the projection 2e and the recess 2f is not limited to one, but a pair of these projections and recesses may be formed. Moreover a resilient projection similar to the resilient projection 31 formed in the outer contact member half 3b may be formed in the outer contact member half 3a. Further the electric wire may be a shield wire. In this case an inner conductor is connected to the pin 1 and an outer shielding conductor is connected to the outer contact member 3.

What is claimed is:

1. A pin plug comprising an inner contact member in the form of pin made of conductive material;

an inner insulating member consisting of two semi-cylindrical halves made of insulating material, said two halves forming in a coupled state with their inner surfaces a hollow cylindrical space extending in an axial direction and receiving said pin;

means formed in said pin and the inner surface of said inner insulating member for fixing said pin in position in said cylindrical space in a separable manner;

means formed in said two halves of the inner insulating member for coupling them together in a separable manner;

an outer contact member consisting of two semi-cylindrical halves and surrounding an outer surface of said inner insulating member;

means formed in said inner insulating member and outer contact member for fixing the outer contact member in position on the outer surface of the inner insulating member in a separable manner;

and an outer insulating member consisting of a hollow cylindrical body made of relatively resilient insulating material and enclosing in a separable manner an assembly of the pin, the inner insulating member surrounding the pin and the outer contact member surrounding the inner insulating member so as to hold the assembly in position;

said two fixing means being formed at such positions that the contact surface of the inner insulating member halves and the contact surface of the outer contact member halves intersect with each other at an angle viewed in the axial direction;

whereby said pin is connected to one of two conductors of an electric wire, the other conductor of which is connected to said outer contact member and said electric wire is slidably passed through said outer insulating member.

2. A pin plug according to claim 1, wherein said means for fixing the pin and the inner insulating member in a separable manner comprise a hole formed in said pin and a projection formed on the inner surface of the inner insulating member and inserted in said hole.

3. A pin plug accoording to claim 1, wherein said means for fixing the outer contact member and the inner insulating member in position in a separable manner comprise recesses formed in the outer surface of the inner insulating member and inwardly projecting lugs formed in the outer contact member and inserted in said recesses.

4. A pin plug according to claim 1, wherein said two halves of the inner insulating member are coupled to each other along one edge parallel to the axial direction in such manner that these two inner insulating member halves can be freely bent along said edge.

5. A pin plug according to claim 4, wherein said means for fixing said two halves of the inner insulating member in a separable manner comprise a hole formed in one of the two halves near an edge opposite to said one edge and a projection formed in the other half near the opposite edge.

6. A pin plug according to claim 1, wherein said two halves of the inner insulating member are formed as separate bodies and said means for fixing these two halves together in a separable manner comprise at least one hole formed in a contact surface of each halves and at least one projection formed in the contact surface of each halves and inserted in said projection.

7. A pin plug according to claim 1, wherein said two fixing means are formed at such positions that the contact surface of the inner insulating member halves is perpendicular to the contact surface of the outer contact member halves viewed in the axial direction.

8. A pin plug according to claim 1, wherein said pin plug further comprises means for fixing said outer insulating member to said assembly in a separable manner.

9. A pin plug according to claim 8, wherein said means comprises a hole formed in the outer insulating member and a projection formed in the outer contact member and inserted in said hole.

10. A pin plug according to claim 1, wherein the pin plug further comprises means for fastening the conductor connected to said pin and said fastening means comprise an elongated projection formed in the inner surface of one of two inner insulating member halves and extending laterally and a corresponding elongated recess formed in the inner surface of the other inner insulating member half and extending laterally, so that said conductor is compressed between said elongated projection and recess.

* * * * *